US005131590A

United States Patent [19]

Sperber

[11] Patent Number: 5,131,590

[45] Date of Patent: Jul. 21, 1992

[54] FIBROUS SPRAYED INSULATION HAVING HOMOGENEOUS DENSITY

[76] Inventor: Henry Sperber, 8 Red Fox La., Englewood, Colo. 80111

[21] Appl. No.: 744,367

[22] Filed: Aug. 13, 1991

[51] Int. Cl.[5] ..... B05B 7/00

[52] U.S. Cl. ..... 239/8; 239/9; 239/427.5

[58] Field of Search ..... 239/8, 9, 427, 432, 239/590.5, 419.3, 427.5, 428, 433; 52/404

[56] References Cited

U.S. PATENT DOCUMENTS

| | | | |
|---|---|---|---|
| 3,957,209 | 5/1976 | Thomson | 239/432 |
| 3,974,965 | 8/1976 | Miller | 239/427 |
| 4,103,876 | 8/1978 | Hasselman, Jr. et al. | 366/178 |
| 4,135,882 | 1/1979 | Harkness et al. | 422/133 |
| 4,213,936 | 7/1980 | Lodrick | 239/432 |
| 4,225,086 | 9/1980 | Sandell | 239/428 |
| 4,402,892 | 9/1983 | Helser | 264/42 |
| 4,447,560 | 5/1984 | Piersol | 421/68 |
| 4,487,365 | 12/1984 | Sperber | 239/8 |
| 4,530,468 | 7/1985 | Sperber | 239/419.3 |
| 4,712,347 | 12/1987 | Sperber | 52/404 |
| 4,768,710 | 9/1988 | Sperber | 239/8 |
| 4,787,131 | 11/1988 | Pacca | 52/404 |
| 4,923,121 | 5/1990 | Boyer | 239/9 |

*Primary Examiner*—Andres Kashnikow
*Assistant Examiner*—Christopher G. Trainor
*Attorney, Agent, or Firm*—Sheridan Ross & McIntosh

[57] ABSTRACT

A sprayed-in fibrous insulation is provided in a substantially homogeneous-density form. A foamed material in its foamed state is mixed with already-lofted fibrous particles and the mixture is sprayed into a desired space. A mixing assembly designed to provide the described mixing of materials and to avoid backflow and consequent clogging or plugging is provided. The velocity of the mixture is increased to a level to cause spraying of the mixture by means of a plurality of hoses, each hose having a smaller inner diameter and cross-sectional area than the preceding hose, with all hoses having a smaller inner diameter and cross-sectional area than the mixing assembly. The foam acts to maintain the fibrous particle loft during impaction from subsequent applications of the insulation material or from the weight of insulation material above. The foam preferably contains an adhesive material which sets or cures to maintain the fiber loft by the time the foam material dries and dissipates.

9 Claims, 3 Drawing Sheets

FIBROUS SPRAYED INSULATION HAVING HOMOGENEOUS DENSITY

FIELD OF THE INVENTION

The present invention is related to a method and apparatus for producing and installing fibrous insulation material and in particular to fibrous insulation which can be sprayed into a desired space so as to adhere to the surfaces of the space, while assuming and maintaining a substantially homogeneous density.

BACKGROUND INFORMATION

Methods for supplying fibrous insulating materials by injection under air pressure provide a generally economical method of insulating a desired space. Such methods are economical at least partly because relatively inexpensive fibrous materials such as cellulose, or mineral fibers, fiberglass and the like can be used, as described, for example, in U.S. Pat. No. 4,487,365 issued Dec. 11, 1984, to Sperber; U.S. Pat. No. 4,530,468 issued Jul. 23, 1985, to Sperber; U.S. Pat. No. 4,712,347 issued to Sperber; and U.S. Pat. No. 4,768,710 issued Sept. 6, 1988, to Sperber and also because of the relative speed with which the insulation can be injected under air pressure compared with the installation of batt-type insulation.

There are two primary methods for supplying fibrous insulating materials by injection under air pressure. In the first, insulation particles mixed with adhesive are inserted into the space between the outer and inner walls of the structure. Since it is desirable to "blow in" the insulation particles and adhesive mixture prior to the construction of the inner walls, a retaining means, as described, for example, in U.S. Pat. No. 4,712,347, by Sperber, issued Dec. 15, 1987, is typically used to retain temporarily the insulation between the wall framing until the inner wall can be constructed to act as a permanent retaining barrier.

The process of blowing-in fibrous insulation has at least one major drawback. The process typically produces insulation with non-homogeneous density. The nonhomogeneity is caused both by the later portions of blown-in insulation impacting and compacting the first portions of blown-in insulation and by the settling of the fibers over time. In general, compacted or densified fibrous insulation has a lower insulating capacity compared to less dense or uncompacted fibrous insulation. Although an adhesive can be used to assist in maintaining the loft of fibrous insulation, as described in U.S. Pat. Nos. 4,487,365; 4,530,468; and 4,712,347 above, the adhesive may have insufficient time to set, cure or dry before impaction from succeeding portions of insulation occurs and may have insufficient strength to withstand the force of impact from succeeding portions of blown-in insulation. Additionally, the adhesive by itself may not be sufficiently spread or mixed with the fibers to provide the desired separation of the fibers.

In the second method for supplying fibrous insulating materials by injection under air pressure, lofted fibers of insulation are mixed with a foam to provide a blown-in fibrous insulation which has a substantially homogeneous density, providing for uniformity of insulation, as disclosed in U.S. Pat. No. 4,768,710. The lofted insulation fibers are created by the mixture of substantially dry fibrous particles with pressurized air. Similarly, the foam is created by the mixture of a foaming agent with pressurized air. The foam and lofted fibers are then introduced into the mixing chamber of a nozzle. Although not discussed in the '710 patent, a single mixing hose is typically connected to the nozzle. The inside diameter of the mixing hose is greater than that of the nozzle outlet. In the mixing chamber and mixing hose, the foamed material is mixed with the lofted fibers so that the foam maintains the loft or the desired spreading of the insulation fibers relative to each other. The length of mixing hose can be approximately two feet. The mixture of fibers and foam material is carried under pressure away from the mixing hose into the desired space, but without any velocity, where the foam maintains the desired loft or spreading of the insulation fibers to achieve a uniform density of the insulation over time.

Like the first method, the apparatus and method of U.S. Pat. No. 4,768,710 has a significant limitation. The apparatus does not eject the foam/insulation mixture with sufficient velocity to cause the mixture to adhere to a surface, even though an adhesive material has been incorporated into the mixture. Rather, as in the first method, placement of the mixture requires the use of some means to retain temporarily the insulation between the wall framing until the inner wall can be constructed to act as a permanent retaining barrier.

In contrast to loose fibrous insulation, insulation comprising a solid "foam" is used in some applications. Although fibrous material can be incorporated into such foam as crystallization sites, fillers, reinforcements and/or pacifiers, as described in U.S. Pat. No. 4,402,892 issued Sept. 6, 1983, to Helser, it is the solid foam itself, rather than the fibers, which produces the insulation effect. To enable such insulation to fill a void, it is first produced in a fluent form and then cured or dried to form the solid foam. Thus, the fluent foam must be capable of substantial solidification into a permanent body. Materials which are capable of this solidification such as a cementitious material, as described in the Helser patent, or resin materials as described in U.S. Pat. No. 4,103,876 issued Aug. 1, 1978, to Hasselman, Jr. et al. and U.S. Pat. No. 4,135,882 issued Jan. 23, 1979, to Harkness et al. are typically more expensive than fibrous insulation materials. Furthermore, many solid foam insulation materials require relatively expensive and time-consuming additional steps to accomplish curing or drying, such as a heating step.

U.S. Pat. No. 4,447,560 issued May 8, 1984, to Piersol describes forming a fibrous sheet by agitating a mixture of a foamable solution and a slurry of binder-coated insulation fibers to homogeneously suspend the fibrous slurry. The present invention differs from the subject matter of the Piersol patent in several important respects. First, unlike the Piersol patent, the present invention does not utilize a slurry of fiber and binder materials but requires the use of pressurized air to provide spreading of insulation fibers to achieve a desired degree of fiber "fluffiness." Second, the foam material desired herein is already in its agitated state when it is mixed with the fibers. Third, the insulation mixture of the present invention is directly sprayed under pressure into a formed cavity at a building construction site; there is no formation of a batt-type insulation or a standard sheet of fibrous material. Finally, there is no step of heating for drying purposes after the insulation material is located in the cavity.

SUMMARY OF THE INVENTION

The present invention is useful in providing a fibrous insulation mixture which is sprayed under pressure into a desired space where the mixture adheres to surfaces of the space. In this manner, no retaining means is necessary to retain the mixture in the desired space. The mixture has a substantially homogeneous density of fibrous insulation so as to provide for uniformity of insulation. Substantially dry fibrous particles are mixed with pressurized air to produce lofted fibers which are introduced into the mixing chamber of the nozzle and then into a mixing hose. A foaming agent and adhesive are mixed with pressurized air to create a foamed adhesive material which is also introduced into a mixing chamber of a nozzle and then into a mixing hose. In the mixing chamber and mixing hose, the lofted fibers are substantially mixed with the foamed adhesive material so that the foam maintains the loft or the desired spreading of the insulation fibers relative to each other. The mixture of fibers and foamed adhesive material is introduced from the mixing hose into a spraying assembly consisting of a plurality of hoses of different inner diameters with the inner diameter of each hose being less than the inner diameter of the nozzle. The mixture of the fibers and foamed adhesive material is ejected from the spraying assembly with a velocity sufficient to cause the mixture to adhere to a surface while substantially reducing separation between the fibers and foam and adhesive material and continuing to maintain the desired loft or spreading of the fibers to achieve uniformity of the insulation. Because of the presence of the foamed adhesive material, the lofted fibers in the desired space are able to withstand the impact from subsequent application of the mixture and are able to maintain the loft or separation of fibers in spite of the weight of insulation material above. To attain the necessary velocity to cause the mixture to spray and adhere to the desired surface, the inner diameters of the spraying hoses are decreased in a stepwise fashion to produce a venturi effect. The mixture components dissociate when the mixture is introduced into a hose having a smaller inner diameter and therefore smaller cross-sectional area of flow. Each spraying hose is of a length sufficient to allow substantial remixing of the mixture of fibers and foamed adhesive material in the hose after a decrease in inner diameter.

After the mixture has been sprayed into the desired space, the adhesive material, after drying, acts to maintain the loft or separation of fibers even when the foam or liquid portion dries or dissipates. In this way, the dried, sprayed-in insulation maintains its insulation capacity by virtue of the fibers rather than the continued presence of a foam. The foam also acts to spread the adhesive for desired mixing with the fibers.

With regard to the nozzle itself, it includes a conduit that carries the foamed adhesive material and which tapers at the nozzle portion where partial mixing of the fibers and foamed adhesive material occurs. This configuration is important in preventing back flow of material into the conduit, particularly whenever the flow of materials is discontinued for a time by shutting off the pressurized air.

DETAILED DESCRIPTION OF THE PREFERRED EMBODIMENT

The present invention relates to an apparatus and method for mixing a foamed adhesive material with lofted fibrous insulation particles and spraying the mixture into a cavity to fill the cavity with fibrous insulation having a substantially homogeneous density. As used herein, "spray" means to provide a mixture of foamed adhesive material and lofted fibrous insulation at a sufficient velocity to allow the mixture to substantially adhere to a surface while substantially reducing separation of the mixture. The apparatus used for mixing the lofted fibrous insulation and foamed adhesive material is disclosed in U.S. Pat. No. 4,768,710 to Sperber, entitled "Fibrous Blow-In Insulation Having Homogeneous Density."

Figure 1:
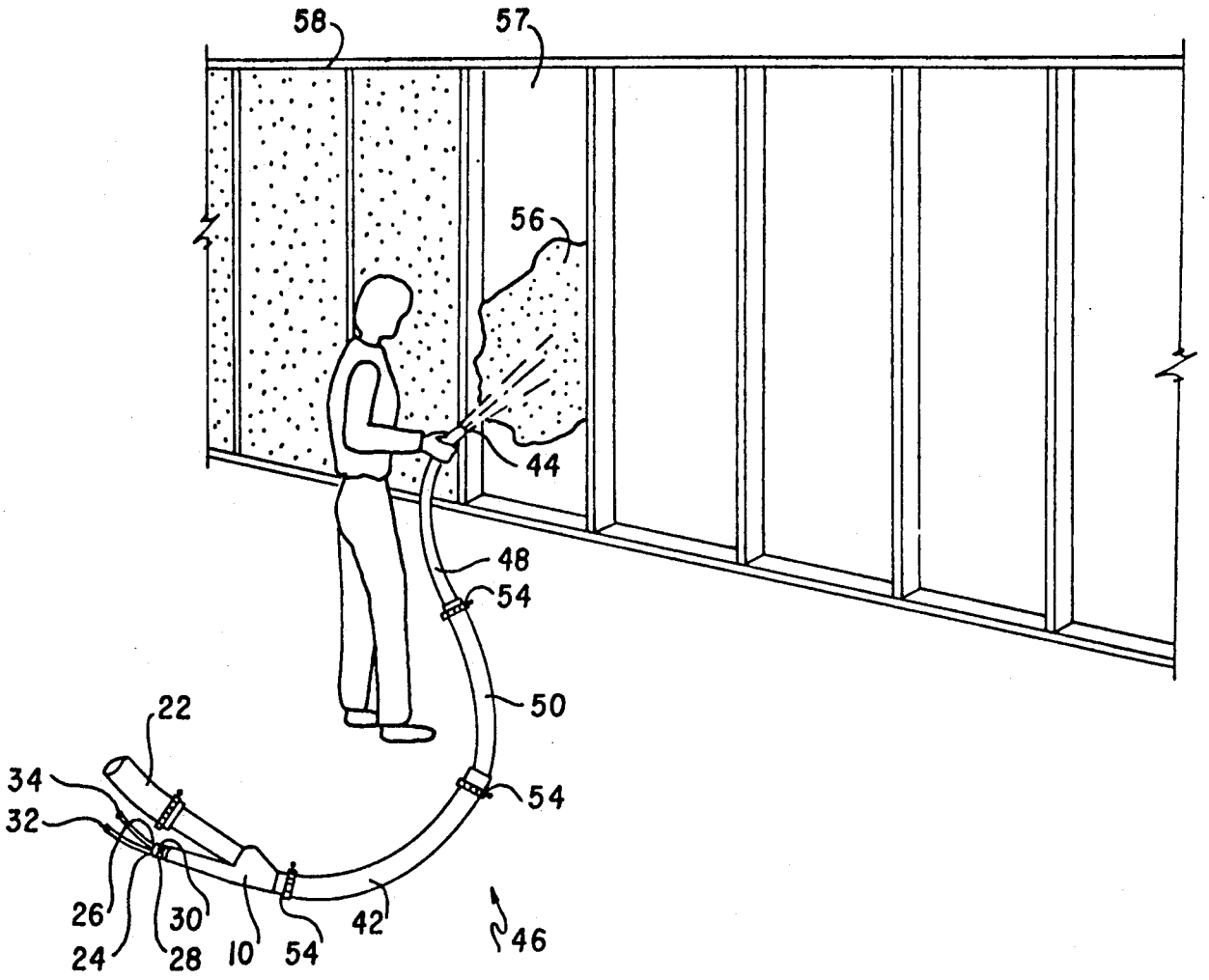
FIG. 1 is a perspective view of a structure illustrating the present invention.
Figure 2:
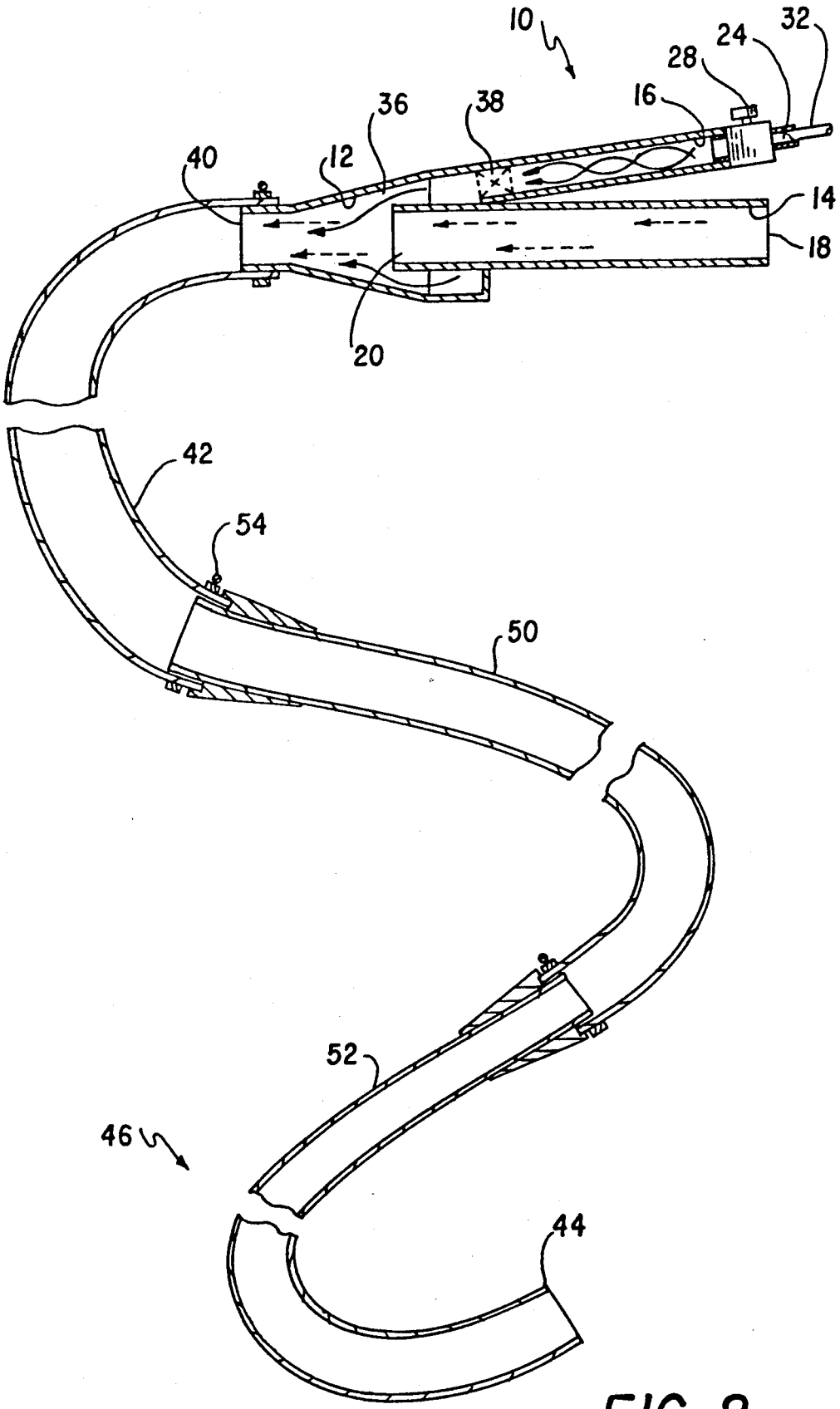
FIG. 2 is a cross-sectional view of the present invention.

Referring to FIGS. 1 and 2, a nozzle 10 includes a mixing chamber 12, a first conduit 14, and a second conduit 16. The first conduit 14 has a first entrance port 18 and a first exit port 20. The first exit port 20 communicates with the mixing chamber 12. The first entrance port 18 of the first conduit 14 is preferably connected to a hose or pipe 22 for introduction through the entrance port 18 of fibrous particles as described below. The second conduit 16 has second and third entrance ports 24, 26 controllable by first and second valves 28, 30, respectively. Connected to the second and third entrance ports 24, 26 are feed lines 32, 34 for introduction of foaming agent and adhesive material and pressurized gas, respectively. The second conduit 16 has a second exit port 36 communicating with the mixing chamber 12. In the region of the second conduit 16 near the second exit port 36, the second conduit 16 is expanded to be located outwardly of the first conduit 14, preferably surrounding the first conduit 14 as a collar. The second conduit 16 tapers towards the first conduit 14 at the mixing chamber 12. The second conduit 16 preferably contains one or more baffles or obstacles 38 to assist in foam production. The mixing chamber 12 is attached to a mixing hose or mixing pipe 42 for completing the mixing of the lofted fibers of insulation and foamed material and directing the insulation material. Based on economics, the most preferred mixing hose length is about two feet, though the longer the mixing hose 42, the more uniform the mixture of insulation particles and foamed adhesive materials. The mixing hose or mixing pipe 42 further includes a first ejection port 40.

To spray the mixture of fibrous lofted insulation particles and foamed adhesive material, it is necessary to increase the velocity of the mixture when it is ejected from a second ejection port 44. Since the increase of the velocity of the fibrous lofted insulation particles and/or foamed adhesive material in the first and/or second conduits, respectively, will prevent optimal mixing of the particles and material, the velocity of the particles and material in the first and second conduits must remain at a level below the velocity necessary to cause spraying of the mixture. The spraying assembly 46 therefore increases the velocity of the mixture by decreasing the cross-sectional area of flow.

In a preferred embodiment the spraying assembly 46 consists of two separate interconnected hoses 50 and 52 connected either to each other or the mixing hose 42 by a connecting means 54, such as a clamp and/or duct tape, with each spraying hose having a smaller inner diameter than the preceding hose and no spraying hose having an inner diameter equal to or greater than the inner diameter of the mixing hose 42. In the preferred embodiment, the inner diameter of the first ejection port 40 and mixing hose 42 is approximately 2.5 inches, the first spraying hose 50 is approximately 2 inches and the second spraying hose 52 is approximately 1.50 to approximately 1.75 inches. As shown in FIG. 2, the inner diameters of the hoses are decreased in a step-wise fashion for the reason that the mixture of fibrous lofted insulation particles and foamed adhesive material was observed to separate whenever there is any reduction in the cross-sectional area of flow of the mixture. When the inner diameter was reduced from approximately 2.5 inches to approximately 1.75 inches through the use of one spraying hose, the insulation particles and foamed adhesive material were too dissociated to apply a uniform mixture of the particles and material to the desired surface. When the desired reduction was accomplished in two spraying hoses, the spraying assembly 46 was found to apply a uniform mixture of the particles and material to the desired surface. Based on these observations, it appears that the degree of separation is directly proportional to the degree of reduction. In other words, it appears that the larger the reduction in cross-sectional area of flow, the greater the dissociation of the insulation particles from the foamed adhesive material. The gradual reduction of the cross-sectional area of flow in two stages causes an initial separation of the mixture components, followed by a gradual remixing, followed by a second separation and a second remixing. At the end of the second spraying hose 52, there is sufficient mixture and sufficient velocity to cause the slurry to spray. To insure sufficient remixing of the mixture components following a decrease in cross sectional area, each spraying hose should have a length of at least about one foot, though the longer the hose, the more uniform the mixture of insulation particles and foamed adhesive material. Based on economics, the most preferred spraying hose length is about two feet. As will be known and understood by those skilled in the art, the number, inner diameters, and lengths of spraying hoses may vary depending upon the desired velocity and/or desired degree of separation of the mixture components.

The manner of using the nozzle 10 and spraying assembly 46 and of production and placement of insulating material 56 will now be described. A foaming agent and adhesive are introduced through the first line 32 and through the second entrance port 24 into the second conduit 16, with the rate of flow being controlled by the first valve 28. Any of a number of foaming agents well known in the art can be used. Foamable adhesives such as polyvinyl acetate, ethylvinyl acetate, animal glues and the like can also be used. A pressurized gas, such as air, is introduced through the second line 34 and through the third entrance port 26 at a rate controlled by the second valve 30. Inside the second conduit 16, the pressurized air mixes with the foaming agent and adhesive materials to produce a foam and adhesive material which moves through the second conduit 16. The baffle or obstacle 38 can be used to assist in producing foam. The foam and adhesive material in its foamed state moves through the first exit port 36 of the second conduit 16 and into the mixing chamber 12 and then into the mixing hose 42.

Substantially dry, lofted fibrous particles which have been lofted by mixing with pressurized air are introduced through the first entrance port 18 into the first conduit 14. The fibrous material can be any fiber well known in the art including mineral fibers, recycled paper and fiberglass. The lofted fibers and pressurized air move through the first conduit 14 and through the first exit port 20 of the first conduit 14 into the mixing chamber 12 and then into mixing hose 42.

In the mixing chamber 12 and mixing hose 42, the foam and adhesive material in its foamed state substantially mixes with the lofted fibers. The tapered area of the second conduit 16 assists in preventing back flow of mixture into the conduits, particularly the second conduit 16. Such back flow can occur, for example, when the flow of insulation mixture through the nozzle 10 is stopped. If the flow of the mixed fibers and foamed adhesive material were permitted back into the second conduit 16, it would be necessary for the operator to frequently clean out or unplug the conduit 16 whenever flow of the mixture is stopped by the operator for some reason, such as moving the apparatus to a new cavity for filling with the insulation. The proportion in which the components are mixed, and particularly the proportion of liquid foaming material and adhesive material to pressurized gas and other material, is preferably adjusted so that the resulting mixture ejected from the second ejection port 44 has a low moisture content per volume and has the ability to adhere to a desired surface when sprayed.

The mixture of fibers and foam and adhesive material is introduced under pressure from the mixing hose 42 into the first spraying hose 50. As shown in FIG. 2, the mixture components separate when the cross-sectional area of flow is decreased. The mixture components are substantially remixed when they enter the second spraying hose 52 and the cross-sectional area of flow is decreased a second time. As before, the mixture components separate when the cross-sectional area of flow is decreased and are substantially remixed by the time the mixture is sprayed from the second ejection port 44.

Figure 3:
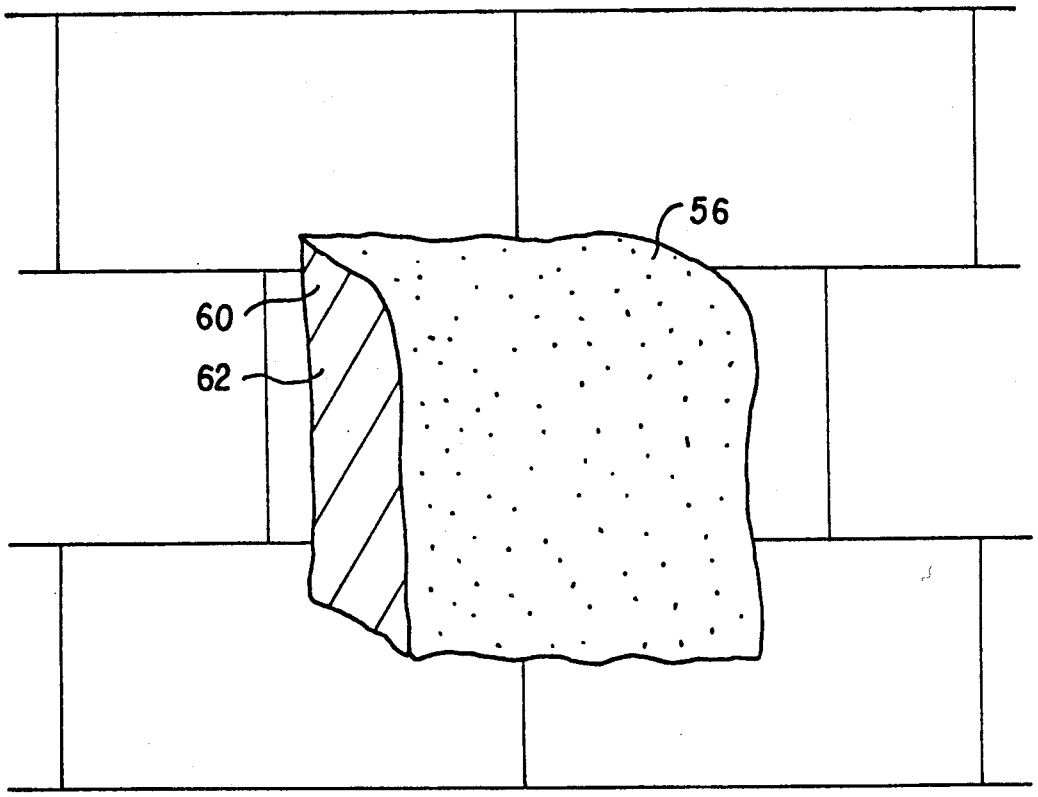
FIG. 3 is a schematic cross-sectional view of the lofted fibers and foam and adhesive mixture applied to a cinder block wall.

As shown in FIGS. 1 and 3, the mixture of fibers and foamed adhesive material 56 which is sprayed from the second ejection port 44 is directed to and received in an area 57 where insulation is desired. In a typical application, the mixture is directed into the cavity of a typical stud-construction wall 58 whereby the foamed insulation can be made and installed at the construction site. Since the present invention has the ability to spray the mixture of fibers and foamed adhesive material, the mixture may be used to install insulation in any other desired cavity, however oriented, including without limitation ceiling and floor cavities. As depicted in FIG. 3, the foamed adhesive material 60 is used to maintain loft or spreading of the insulation fibers 62 relative to each other. The material 60 maintains such loft or spreading of fibers even when it is impacted by subsequent applications of the mixture ejected from the second ejection port 44 and maintains loft or separation of fibers in spite of the weight of insulation material above.

After the mixture has been placed in the desired area 57 as depicted in FIG. 1, the mixture may be sculpted into any desired shape or texture by, for example, the use of a trowel. The moisture in the mixture dries in the ambient atmosphere, without the necessity for application of heat or other drying procedures. With the drying of the moisture, the material 60 dissipates leaving only the fibrous particles 62 and adhesive which maintained the fibrous particles in a desired, spread state.

In light of the above discussion of the preferred embodiment, a number of advantages of the present invention are apparent. First, a sprayed-in fibrous insulation is provided which results in substantial uniformity of insulation, i.e., substantially homogeneous density. Although a foam is used, it does not have to be used to create loft or to create air pockets, but rather is used to maintain a previously-established loft between fibrous particles. Indeed, the foam itself eventually dissipates leaving lofted fibrous particle insulation. Second the foamed insulation of the present invention can be made and installed on the job or construction site. Third, because the insulation is sprayed in rather than being a batt-type insulation, the insulation does not need to be extensively handled. Fourth, because the foam is used only to maintain an already-created loft and is not a structural component of the insulation, at least in the long-term, the foam can be relatively dry, also contributing to rapid drying of the insulation in the desired space without the requirement for application of heat. Fifth, as opposed to a permanent foam insulation, the sprayed-in fibrous insulation uses relatively inexpensive materials such as recycled paper, mineral fibers or fiberglass and is easy to apply, conforming naturally to obstacles such as wiring, pipes and the like. Sixth, a tapered nozzle portion of the present invention reduces or prevents the flow of foamed insulating material back into the conduit that carries the mixture of foaming material and adhesive As a consequence, this conduit does not become plugged with fiber material. Seventh, unlike prior art methods of "blowing in" fibrous insulation, the mixture of foamed insulation applied by the present invention adheres to the surfaces of the desired cavity and no temporary retaining means is required to retain the insulation during installation. Eighth, unlike the prior art, the present invention may be used to fill any desired cavity with insulation, including, for example, not only walls but also floors and ceilings. Finally, the sprayed-on insulation of the present invention may, before drying, be sculpted into any desired shape or texture by, for example, the use of a trowel.

Although the present invention has been described with reference to certain embodiments, it should be appreciated that further modifications can be effected within the spirit and scope of the invention.

What is claimed is:

1. An apparatus for ejecting fibrous insulation comprising:

mixing means having a first ejection part;

a first conduit having a first entrance port and a first exit port, said first exit port communicating with said mixing means;

first means for introducing a mixture of fibrous particles and pressurized air into said first conduit through said first entrance port wherein said fibrous particles move through said first conduit into said mixing means;

a second conduit having second and third entrance ports and a second exit port, said second exit port communicating with said mixing means;

second means for introducing a liquid comprising a foaming agent and adhesive into said second conduit through said second entrance port;

third means for introducing pressurized air into said second conduit through said third entrance port, wherein a foamed adhesive material moves through said second conduit into said mixing means; and spraying means for generating sufficient velocity of the mixture of said fibrous particles and said foamed adhesive material to cause said mixture to substantially adhere to a surface while substantially reducing separation between said fibrous particles and said foamed adhesive material, said spraying means including a plurality of hoses having different inner diameters, said inner diameters being less than the inner diameter of said first election port and said hoses each having a length sufficient to allow substantial remixing of the fibrous particles and the foamed adhesive material.

2. An apparatus, as claimed in claim 1, wherein:

said spraying means includes two hoses, with each of said hoses having a said length of at least one foot.

3. An apparatus, as claimed in claim 1, wherein:

the amounts of said pressurized air introduced into said first conduit and said second conduit is that amount necessary to cause substantial mixing of said fibrous particles and said foamed adhesive material in said mixing means.

4. An apparatus, as claimed in claim 1, wherein:

said mixing means includes a mixing chamber, and at least one of said plurality of hoses having a said length greater than the length of said mixing chamber.

5. In an apparatus for ejecting fibrous insulation wherein fibrous particles and pressurized air are introduced into mixing means through a first conduit, a foamed adhesive material and pressurized air are introduced into said mixing means through a second conduit, said fibrous particles are mixed with said foamed adhesive material in said mixing means, and the mixture of said fibrous particles and said foamed adhesive material is ejected from said mixing means through a first ejection port, the improvement comprising a spraying means for generating sufficient velocity of said mixture to cause said mixture to substantially adhere to a surface while substantially reducing separation between said fibrous particles and said foamed adhesive material, said spraying means including a plurality of hoses having different inner diameters, said inner diameters being less than the inner diameter of said first ejection port and each of said hoses having a length sufficient to allow substantial remixing of the fibrous particles and the foamed material.

6. An apparatus, as claimed in claim 5, wherein:

the amounts of said pressurized air introduced into said first conduit and said second conduit is that amount necessary to cause substantial mixing of said fibrous particles and said foamed adhesive material in said mixing means.

7. A method for filling a space with insulating material, comprising:

providing mixing means;

providing a plurality of insulation fibers;

feeding said insulation fibers towards said mixing means;

providing a foamed adhesive material in its foamed state;

providing spraying means including a plurality of hoses having different inner diameters, said inner diameters being less than an inner diameter of said mixing means and each of said hoses having a said length sufficient to allow substantial remixing of said insulation fibers and said foamed adhesive material;

mixing in said mixing means said fibers and said foamed adhesive material in its foamed state;

forcing said mixture of said fibers and said foamed adhesive material under pressure away from said spraying means at a sufficient velocity to cause said mixture to substantially attach to a surface while substantially reducing separation between said insulation fibers and said foamed adhesive material;

using said foamed adhesive material to maintain a desired spreading of said insulation fibers relative to each other during the spraying of said mixture towards the space;

receiving said mixture at the space for insulation purposes; and using said foamed adhesive material of said mixture during continuous receiving of the mixture at the space to maintain the desired spreading of said insulation fibers to achieve a uniform density of insulation.

8. A method, as claimed in claim 7, wherein:

said plurality of hoses includes two hoses, with each of said hoses having a said length of at least one foot.

9. A method, as claimed in claim 7, wherein:

said mixing means includes a mixing chamber, at least one hose of said plurality of hoses having a said length greater than the length of said mixing chamber.

* * * * *